US007236723B2

(12) United States Patent
Robles Flores et al.

(10) Patent No.: US 7,236,723 B2
(45) Date of Patent: Jun. 26, 2007

(54) SHIELD FOR CHARGING DEVICE IN XEROGRAPHIC PRINTING DEVICE HAVING ENHANCED VOLTAGE AND CURRENT UNIFORMITY

(75) Inventors: Eliud Robles Flores, Webster, NY (US); John Robert Uchal, Webster, NY (US)

(73) Assignee: Xerox Corporation, Stamford, CT (US)

( * ) Notice: Subject to any disclaimer, the term of this patent is extended or adjusted under 35 U.S.C. 154(b) by 3 days.

(21) Appl. No.: 11/191,959

(22) Filed: Jul. 29, 2005

(65) Prior Publication Data

US 2007/0025770 A1 Feb. 1, 2007

(51) Int. Cl.
*G03G 15/02* (2006.01)

(52) U.S. Cl. ..... 399/172; 399/173; 250/324

(58) Field of Classification Search ..... 399/170–175, 399/115, 168, 311; 250/324–326
See application file for complete search history.

(56) References Cited

U.S. PATENT DOCUMENTS 3,564,239 A * 2/1971 Kushima ..... 250/324
5,175,666 A * 12/1992 Saito ..... 399/171
5,742,874 A * 4/1998 Koshimura et al. ..... 399/173
6,070,026 A * 5/2000 Claflin et al.
6,944,413 B2 * 9/2005 Maeda ..... 399/172

* cited by examiner

*Primary Examiner*—David M. Gray
*Assistant Examiner*—Laura K. Roth
(74) *Attorney, Agent, or Firm*—Oliff & Berridge, PLC

(57) ABSTRACT

A xerographic printing device, including a charging device having a shield. In some embodiments of the shield of the charging device in the xerographic printing device, three slots are provided with one slot in the upstream process direction and the other two slots sharing a common axis in downstream process direction and neither an overlap nor a gap existing between the ends of any of the slots in a longitudinal direction. In another embodiment, a plurality of holes are included in the shield. The charging device can be a corotron, a dicorotron, a scorotron, a discorotron, a pin corotron, a pin scorotron, or any other known or later developed charging device of that type.

18 Claims, 13 Drawing Sheets

SHIELD FOR CHARGING DEVICE IN XEROGRAPHIC PRINTING DEVICE HAVING ENHANCED VOLTAGE AND CURRENT UNIFORMITY

BACKGROUND

This application relates generally to xerographic printing devices including charging devices such as corotrons, scorotrons, AC dicorotrons, AC discorotrons, and the like.

Xerographic printing machines often include charging devices such a corotron, dicorotron, scorotron or discorotron. A corotron is a wire device. A dicorotron is a corotron where the wire has a glass coating. A scorotron is a corotron with a grid on top of it. Similarly, a discorotron is a dicorotron with a grid on top of it. Other charging devices used in xerographic printing machines include pin corotrons and pin scorotrons. The pin variations of these devices substitute a series of pins for a smooth wire or substitute an etched wire having tips resembling a series of pins in a saw tooth shape. Some of these pin based charging devices include an array of pins comprising two or more lines of pins.

Some xerographic printing machines include a photoreceptor. Some photoreceptors are shaped with a surface resembling a belt. When charging the photoreceptor in a xerographic printing machine, it is desirable for the charge to be uniform around the surface of the belt. Variations in the magnitude of the charge around the surface of the photoreceptor are referred to as charge non-uniformities. Charge non-uniformities result in variations in image intensity in a resulting print where the original image does not vary in intensity. Non-uniformities that occur across the width of the photoreceptor are referred to as cross-web non-uniformities. Non-uniformities that occur along the length of the photoreceptor are referred to as down-web non-uniformities. Similar concepts apply to the current uniformity of the charging device.

When operating a scorotron or discorotron charging device, for example, a bias voltage is typically applied. This bias voltage typically corresponds to a charge to which it is desired to charge the photoreceptor. Bias voltages typically range from 300 volts to 1,000 volts. A typical average bias voltage is in the range of 400 to 500 volts.

Some xerographic engines have problems arising from voltage and/or current non-uniformities. Variances in electrical conductivity can be a function of device operation history such as, e.g., powered versus unpowered. This conductivity variation can also cause an operating voltage variation.

Other causes of current and voltage non-uniformities relate to harmful corona effluents in the apparatus and to the method of removing the harmful corona effluents from the machine cavity. The harmful corona effluents are caused by the ionization of the air in the vicinity of a charge that typically exceeds 4,000 volts. This ionization of the air in the vicinity of a high electrical charge generates several gases including ozone. These gases are typically filtered and reconditioned but they can be highly dangerous and even toxic at certain levels of concentration. Therefore, a vacuum is typically employed in the cavity of the machine to remove these unwanted gases including ozone.

Typically, a shield on top of the charging device includes some sort of orifice in order for the vacuum to properly remove the unwanted gases from the machine cavity. However, the quantity, shape and orientation of the orifices in the shield, and the associated air flow generated by the vacuum removal of unwanted gases affect the charge uniformity and the current uniformity of the photoreceptor. Thus, the vacuum removal of unwanted gases from the machine cavity is another among the causes of charge non-uniformity in the photoreceptor.

There are many byproducts of the ionization process described above. In addition to ozone, NOx is another undesirable byproduct. For example, when NOx attaches to $H_2O$, nitric acid is created. Nitric acid is also very harmful and can also be toxic.

With respect to the architecture of the xerographic printing machine, one convention refers to points furthest inside the machine, that is, points furthest away from a user standing in front of the machine, as inboard portions of the machine. Similarly, according to this convention, portions of the machine closest to the front of the machine, that is, points nearest where a user stands, are referred to as outboard portions of the machine. In one architecture for a xerographic printing machine, the Cross-web orientation of the photoreceptor corresponds to the inboard to outboard or outboard to inboard direction. Similarly, according to this nomenclature, the down-web direction is also referred to as the process direction. This nomenclature is used herein to define a lateral direction and a longitudinal direction.

SUMMARY

In various exemplary embodiments, a current or wind created in the ionized air at the tips of the pins of the charging device is more concentrated. As described in more detail hereinafter, the various exemplary embodiments achieve an enhanced voltage uniformity and an enhanced current uniformity in photoreceptor charging devices used in xerographic printing machines.

In various exemplary embodiments, other corona effluents are reduced.

In various exemplary embodiments, corona effluents are more efficiently removed from the machine cavity.

In various exemplary embodiments, the efficient removal of harmful corona effluents from the machine cavity results in improved charge uniformity and improved current uniformity.

In various exemplary embodiments, the more efficient removal of harmful corona effluents from the machine cavity results in improved print quality.

In various exemplary embodiments, more than one charging device is used. Thus, in various exemplary embodiments a scorotron is used as a primary charging device and a discorotron is used as a secondary recharging device. In various exemplary embodiments, the pin scorotron charges the photoreceptor to a voltage higher than the desired voltage and then a discorotron is used to gradually dissipate some of the overcharged voltage resulting in a more uniform charge.

In various exemplary embodiments, a discorotron charging device is used.

In various exemplary embodiments, a specific design of a shield in the charging device is employed to achieve one or more of the foregoing benefits.

In various exemplary embodiments, a shield for a charging device is employed having a plurality of slots.

In various exemplary embodiments, a shield for a charging device is employed having a plurality of slots that are offset in a longitudinal direction.

In various exemplary embodiments, a shield for a charging device is employed having a plurality of slots that do not overlap in a longitudinal direction.

In various exemplary embodiments, a shield for a charging device is employed having a plurality of slots that do not overlap and have a gap in a longitudinal direction.

In various exemplary embodiments, a shield for a charging device is employed having a plurality of vacuum holes.

In various exemplary embodiments, a shield for a charging device is employed having a single vacuum slot.

In various exemplary embodiments, one or more of the previously described embodiments are combined.

Thus, an exemplary printing machine comprises a charging device that forms a variable charging device operating voltage. In one exemplary embodiment of a printing machine, a scorotron charging device operates on a constant current of 2.085 mA. The power supply output voltage varies to maintain this constant current. A voltage monitor signal is available to the machine control system along with the grid voltage.

In various exemplary embodiments, a High Frequency Service Interval cleaning interval remains on the faulted charging device. This information can be used to instruct an operator to clean or replace the charging device. In various exemplary embodiments, this determination depends on the run time since the last cleaning. A charging device that trips a fault shortly after a previous cleaning would be replaced. A fault that occurs close to the cleaning interval would instruct the operator to clean the device.

These and other problems overcome by, and other features and advantages of this invention, are described in, or are apparent from, the following detailed description of various exemplary embodiments according to this invention.

BRIEF DESCRIPTION OF THE DRAWINGS

Various exemplary embodiments of this invention will be described in detail, with reference to the following figures, wherein.

DETAILED DESCRIPTION OF EMBODIMENTS

Figure 1:
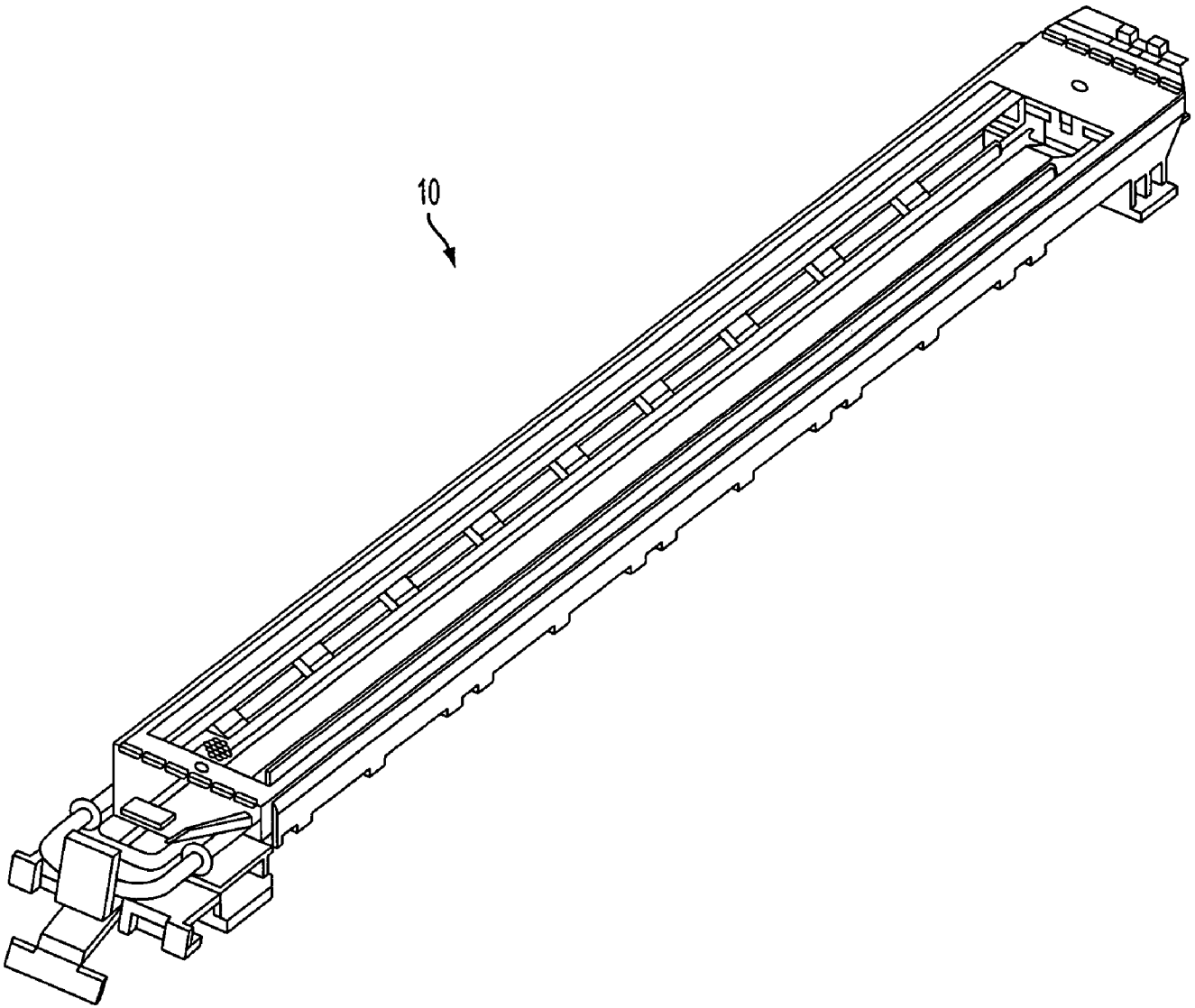
FIG. 1 is a perspective schematic of one exemplary embodiment of a pin scorotron with the hex pattern of the grid removed.

FIG. 1 is a perspective schematic of one exemplary embodiment of a scorotron 10 with the grid removed. Corotrons, scorotrons, AC dicorotrons, AC discorotrons, and the like, are well known in the field of xerographic charging devices. In various exemplary embodiments, any currently known or later developed style of scorotron 10, or corotrons, AC dicorotrons, AC discorotrons, or the like, currently known or later developed, may be used.

Figure 2:
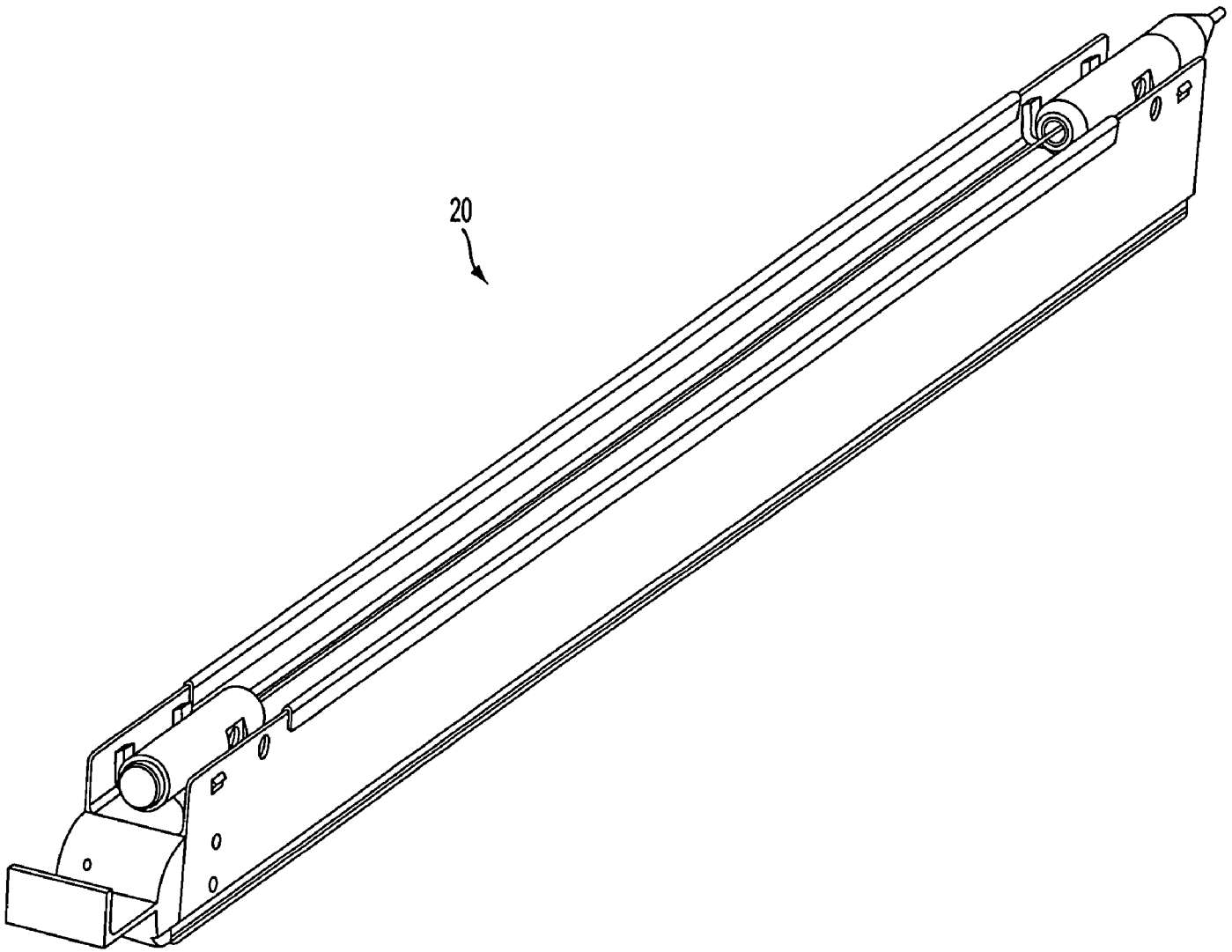
FIG. 2 is a perspective schematic of one exemplary embodiment of an AC dicorotron with the grid removed.

FIG. 2 is a perspective schematic of one exemplary embodiment of an AC dicorotron 20 with the grid removed. AC dicorotrons are well known in the field of xerographic charging devices. In various exemplary embodiments, any type of AC dicorotron 20, or scorotron, corotrons, AC discorotrons, or the like, currently known or later developed, may be used.

Figure 3:
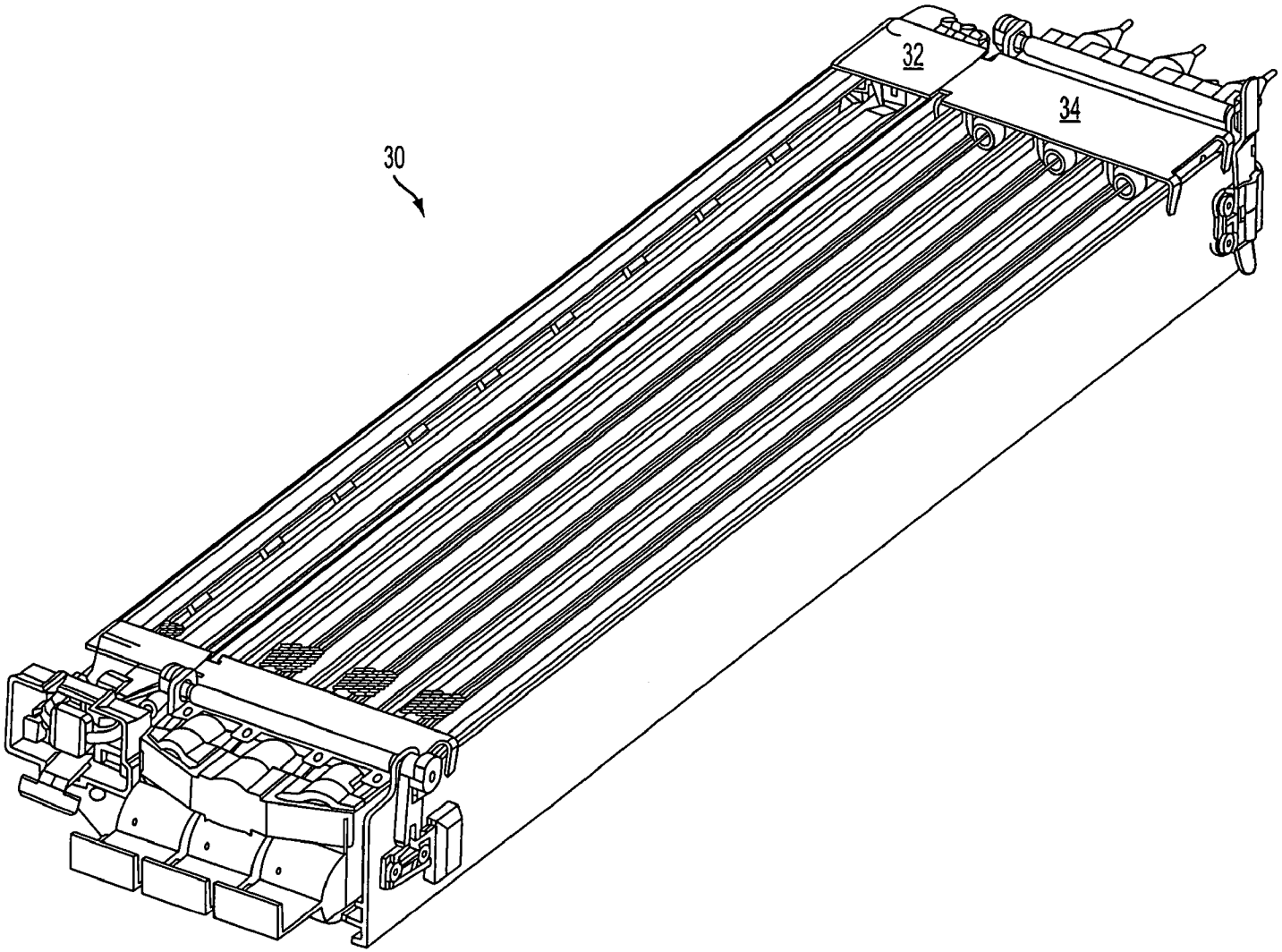
FIG. 3 is a perspective schematic of one exemplary embodiment of a charge-recharge station including one pin scorotron and three AC dicorotrons with the hex pattern of their grids removed.

FIG. 3 is a perspective schematic of one exemplary embodiment of a charge-recharge station 30. The exemplary charge-recharge station 30 includes one pin scorotron in housing 32 and three AC dicorotrons in housing 34. Most of the portions of the grids are removed from the top of the pin scorotron in housing 32 and from the top of the three AC dicorotrons in housing 34. In various exemplary embodiments, any currently known or later developed style of charge-recharge station 30 may be used. Thus, in various exemplary embodiments, a charge-recharge station 30 is employed including a number of pin scorotrons other than one. Similarly, in various exemplary embodiments, a charge-recharge station 30 is employed using a number of AC dicorotrons other than three. Likewise, in various exemplary embodiments, a charge-recharge station 30 is employed using one or more type of xerographic charging device other than a pin scorotron or an AC discorotron, including, but not limited to, discorotrons. In various exemplary embodiments, a charge-recharge station 30 is employed using any combination of known or later developed type of xerographic charging device.

Figure 4:
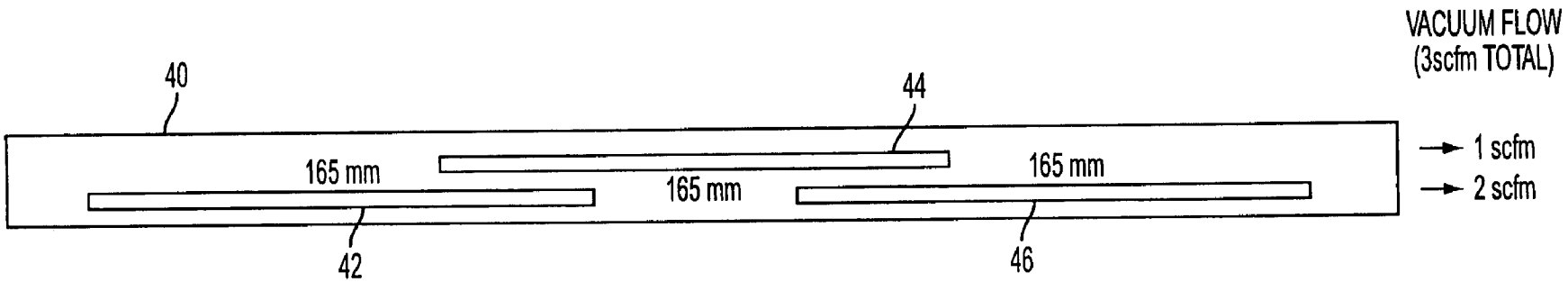
FIG. 4 is a top plan view of an exemplary embodiment of a charging device shield.

FIG. 4 is a top plan view of an exemplary embodiment of a charging device shield 40. The exemplary charging device shield 40 includes vacuum slots 42, 44, 46. Vacuum slots 42 and 46 share a common axis in a lateral direction. The lateral direction corresponds to the direction in which the print process flows, or down-web direction. In the depicted embodiment, vacuum slot 44 is in the upstream process direction and the axis shared by vacuum slot 42 and 46 is in a downstream process direction with respect to vacuum slot 44. Vacuum slot 44 has an axis in a lateral direction different than the common axis shared by vacuum slot 42 and vacuum slot 46.

The total vacuum flow through vacuum slots 42, 44, 46 is three standard cubic feet per minute (scfm). The 3 scfm total vacuum flow through vacuum slots 42, 44, 46 is distributed as follows. Vacuum slot 44 has a total flow of 1 scfm. Vacuum slots 42, 46 share a combined vacuum flow of 2 scfm. In various exemplary embodiments, the vacuum flow through slots 42, 44, 46 is distributed according to a different ratio. Thus, in various exemplary embodiments, the total vacuum flow is a value other than 3 scfm.

In this exemplary embodiment, vacuum slot 42 is 165 mm long. Similarly, in this exemplary embodiment, vacuum slot 44 is 165 mm long. Likewise, in this exemplary embodiment, vacuum slot 46 is 165 mm long. Thus, in this exemplary embodiment, vacuum slot 42, vacuum slot 44 and vacuum slot 46 all have the same length. In various other exemplary embodiments, one or more of vacuum slot 42, vacuum slot 44 and vacuum slot 46 have a length that is different than the other vacuum slots. Thus, in various exemplary embodiments, vacuum slot 42, vacuum slot 44, and vacuum slot 46 have other lengths.

In FIG. 4, one end of vacuum slot 44 overlaps an end of vacuum slot 42 in a longitudinal direction. The longitudinal direction corresponds to the inboard/outboard or cross-web direction. An opposing end of vacuum slot 44 overlaps an end of vacuum slot 46 in the longitudinal direction. This overlapping structure in the longitudinal direction typifies the exemplary embodiment of charging device shield 40.

Vacuum slot 44 overlaps vacuum slot 42 for about one-third of the length of vacuum slot 44. Similarly, vacuum slot 44 overlaps vacuum slot 46 for about one-third of the length of vacuum slot 44. Thus, the length of the overlap between vacuum slot 42, vacuum slot 44 and vacuum slot 46 is approximately 25 mm to 55 mm for each overlapping portion.

As a consequence of the overlapping structure of exemplary charging device shield 40, the air flow is greater in the vicinity where the vacuum slots 42, 44, 46 overlap than the air flow in an area where vacuum slot 42 is present but not overlapping with vacuum slot 44, an area where vacuum slot 44 is present but not overlapping with either vacuum slot 42 or vacuum slot 46, and an area where vacuum slot 46 is present but not overlapping with vacuum slot 44. Because of this differential in air flow at different points on the exemplary charging device shield 40, the effects on the voltage uniformity and current uniformity of the charging device are variable depending on the location on the device. This variance in the charge uniformity and the current uniformity have a negative effect on the operation of the device and thus on subsequent print quality.

For example, the overlapping structure of exemplary charging device shield 40 is believed to induce voltage spikes. These voltage spikes are manifested as cross-web non-uniformities. The cross-web non-uniformities take away smoothness of the charging process. One way that this occurs is by the addition of higher frequency noise to the cross-web voltage profile. These interactions and competing effects can lead to an instability in the air flow. The instability in the air flow can include urging an air flow in the opposite direction as the vacuum removal of the corona effluents. Thus, the instability in air flow can inhibit the efficient removal of the corona effluents. This will be discussed in greater detail below.

The performance of exemplary charging device shield 40 was compared to the performance of other exemplary charging device shields in tests. The results of these tests are depicted in FIGS. 10-13 and described below in connection with those figures.

Figure 5:
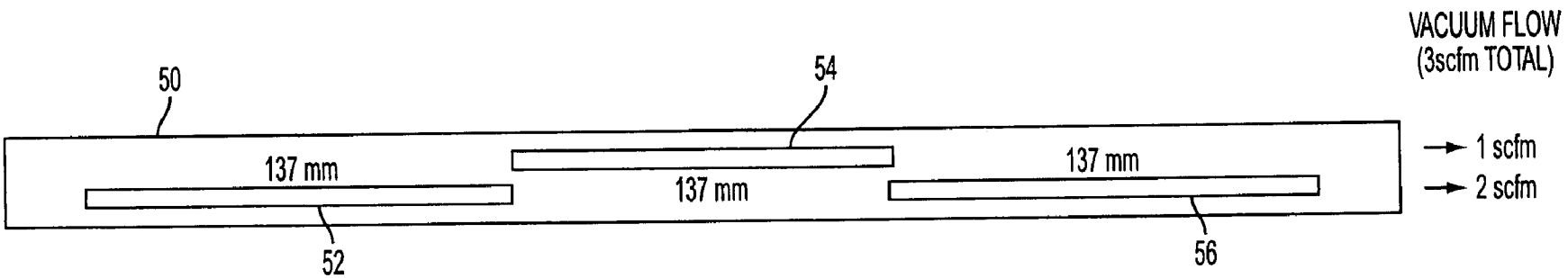
FIG. 5 is a top plan view of a second exemplary embodiment of a charging device shield.

FIG. 5 is a top plan view of a second exemplary embodiment of a charging device shield 50. The exemplary charging device shield 50 includes three vacuum slots 52, 54, 56. Exemplary vacuum slots 52 and 56 share a common axis in the lateral direction. Exemplary vacuum slot 54 has an axis in the lateral direction different than the common axis shared by exemplary vacuum slots 52 and 56.

In this exemplary embodiment, vacuum slot 52 is 137 mm long. Similarly, in this exemplary embodiment vacuum slot 54 is 137 mm long. Likewise, in this exemplary embodiment, vacuum slot 56 is 137 mm long. Thus, in various exemplary embodiments, the length of vacuum slot 52 is the same as the length of vacuum slot 54 and vacuum slot 56. In other various exemplary embodiments, vacuum slot 52, vacuum slot 54, and vacuum slot 56 have lengths that are not the same. In various exemplary embodiments, vacuum slot 52, vacuum slot 54, and vacuum slot 56 have other lengths.

Vacuum slots 52, 54, 56 are oriented on the exemplary embodiment of charging device shield 50 such that there is no overlap in the longitudinal direction between any of the ends of vacuum slots 52, 54, 56. However, vacuum slot 54 is positioned longitudinally between vacuum slots 52, 56 such that there is no longitudinal gap between a first end of vacuum slot 54 and an end of vacuum slot 52, or between a second end of vacuum slot 54 opposing the first end of vacuum slot 54 and an end of vacuum slot 56. This structure typifies the second exemplary embodiment of charging device shield 50.

As with exemplary charging device shield 40, the total vacuum flow through vacuum slots 52, 54, 56 in exemplary charging device shield 50 is 3 scfm. In various exemplary embodiments, the total vacuum flow is a value other than 3 scfm. The total vacuum flow of 3 scfm is distributed between slots 52, 54, 56 in the same manner as the distribution of vacuum flow in exemplary charging device shield 40. Thus, exemplary vacuum slot 54 has a flow of 1 scfm, and exemplary vacuum slots 52, 56 share a total flow of 2 scfm. In various exemplary embodiments, the vacuum flow through slots 52, 54, 56 is distributed according to a different ratio.

The performance of the second exemplary embodiment of charging device shield 50 will be compared with the performance of the exemplary embodiment of charging device shield 40, and other exemplary embodiments of a charging device shield in connection with further disclosure below.

Figure 6:
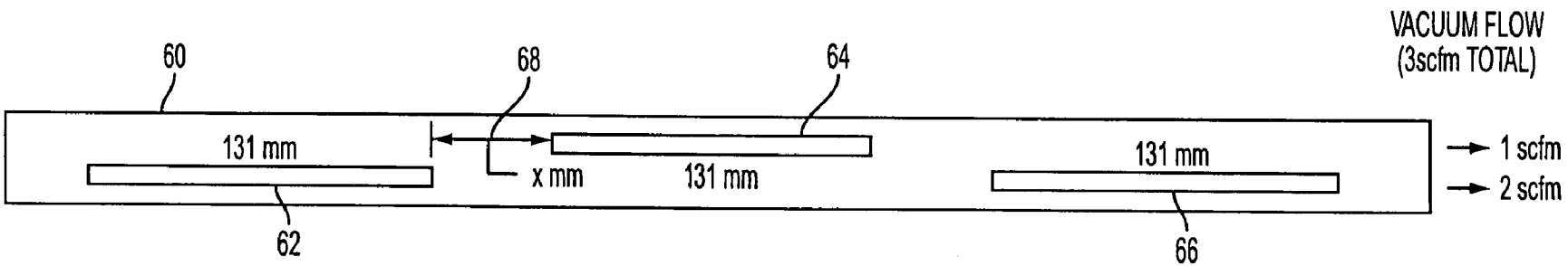
FIG. 6 is a top plan view of a third exemplary embodiment of a charging device shield.

FIG. 6 is a top plan view of a third exemplary embodiment of a charging device shield 60 having vacuum slots 62, 64, 66. In this exemplary embodiment, vacuum slot 62 is 131 mm long. Similarly, in this exemplary embodiment, vacuum slot 64 is 131 mm long. Likewise, in this exemplary embodiment, vacuum slot 66 is 131 mm long. Thus, in various exemplary embodiments, the length of vacuum slot 62 is the same as the length of vacuum slot 64 and vacuum slot 66. In other various exemplary embodiments, vacuum slot 62, vacuum slot 64 and vacuum slot 66 have lengths that are not the same. In various exemplary embodiments, vacuum slot 62, vacuum slot 64, and vacuum slot 66 have other lengths.

Exemplary vacuum slot 62 and exemplary vacuum slot 66 share a common axis in the lateral direction. Exemplary vacuum slot 64 has an axis in the lateral direction different than the common axis shared by vacuum slot 62 and vacuum slot 66. As with exemplary charging device shield 50, exemplary vacuum slots 62, 64, 66 do not have any overlapping portions in the longitudinal direction. Further, a gap 68 exists between one end of exemplary vacuum slot 62 and vacuum slot 64 in the longitudinal direction. A similar gap exists between the opposing end of vacuum slot 64 and vacuum slot 66 in the longitudinal direction. Exemplary gap 68 is represented as x mm in length. In various exemplary embodiments, the value of x is different. The various exemplary embodiments having certain values of x will be discussed in greater detail below in connection with the tests depicted in FIG. 11.

As with exemplary embodiment of charging device shield 40 and the second exemplary embodiment of charging device shield 50, the total vacuum flow for the third exemplary embodiment of charging device shield 60 is 3 scfm total. In various exemplary embodiments, the total vacuum flow is a value other than 3 scfm. The 3 scfm total vacuum flow is distributed between vacuum slot 62, vacuum slot 64 and vacuum slot 66 as follows. The vacuum flow through vacuum slot 64 is 1 scfm and the vacuum flow through vacuum slot 62 and vacuum slot 66 is 2 scfm combined. In various exemplary embodiments, the vacuum flow through slots 62, 64, 66 is distributed according to a different ratio.

Various exemplary test results comparing the performance of the third exemplary embodiment of charging device shield 60, the second exemplary embodiment of charging device shield 50 and the first exemplary embodiment of charging device shield 40 will be discussed in greater detail below in connection with FIG. 11.

Figure 7:
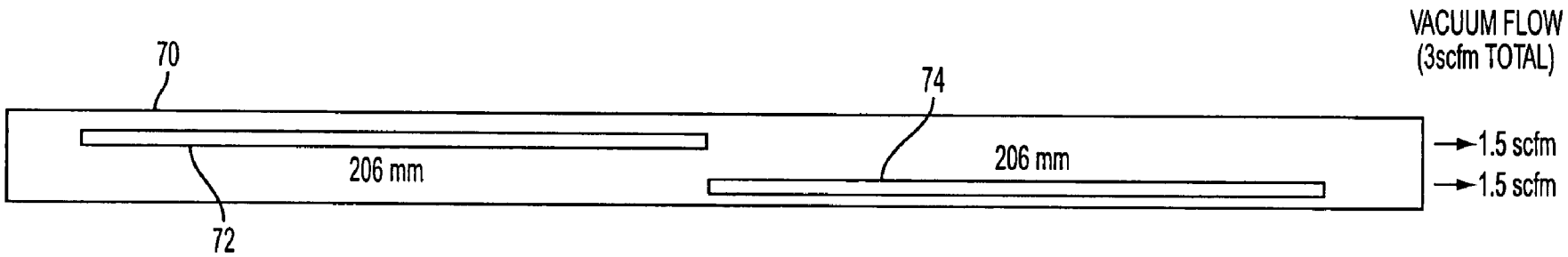
FIG. 7 is a top plan view of a fourth exemplary embodiment of a charging device shield.

FIG. 7 is a top plan view of a fourth exemplary embodiment of a charging device shield 70. The exemplary charging device shield 70 includes vacuum slot 72 and vacuum slot 74.

In various exemplary embodiments, vacuum slot 72 is 206 mm long. Likewise, in various exemplary embodiments vacuum slot 74 is 206 mm long. Thus, in various exemplary embodiments, the length of vacuum slot 72 is the same as the length of vacuum slot 74. In other various exemplary embodiments, vacuum slot 72 and vacuum slot 74 have lengths that are not the same. In other exemplary embodiments, vacuum slot 72 and vacuum slot 74 have other lengths.

Vacuum slot 72 has a lateral axis, and vacuum slot 74 has a lateral axis. The lateral axis of vacuum slot 72 and the lateral axis of vacuum slot 74 are not in alignment. Further, vacuum slot 72 and vacuum slot 74 do not have any overlapping portions in either the lateral or the longitudinal direction. Also, there is no gap between the ends of vacuum slot 72 and vacuum slot 74 in the longitudinal direction.

As with the first exemplary embodiment of charging device shield 40, the second exemplary embodiment of charging device shield 50 and the third exemplary embodiment of charging device shield 60, so too the fourth exemplary embodiment of charging device shield 70 has a total vacuum flow of 3 scfm. In various exemplary embodiments, the total vacuum flow is a value other than 3 scfm. In the fourth exemplary embodiment of charging device shield 70, the total vacuum flow is distributed in even proportions between vacuum slot 72 and vacuum slot 74. Thus, in this exemplary embodiment, vacuum slot 72 has a flow of 1.5 scfm and vacuum slot 74 has a flow of 1.5 scfm. In other exemplary embodiments, the flows are different, and are distributed in differing proportions.

Figure 8:
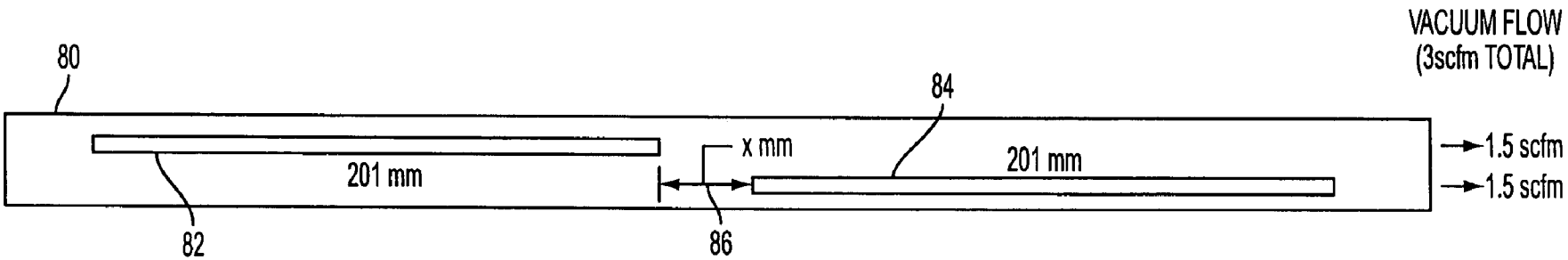
FIG. 8 is a top plan view of a fifth exemplary embodiment of a charging device shield.

FIG. 8 is a top plan view of a fifth exemplary embodiment of a charging device shield 80 having an exemplary vacuum slot 82 and an exemplary vacuum slot 84. Exemplary vacuum slot 82 is 201 mm long. Exemplary vacuum slot 84 is also 201 mm long. Thus, in this exemplary embodiment, vacuum slot 82 and vacuum slot 84 are the same length. In various other exemplary embodiments, vacuum slot 82 and vacuum slot 84 are not the same length. In various other exemplary embodiments, vacuum slot 82 and vacuum slot 84 have different values.

In exemplary charging device shield 80, the vacuum slot 84 has a lateral axis and the vacuum slot 82 has a lateral axis. In this exemplary embodiment, the lateral axis of vacuum slot 82 is not in alignment with the lateral axis of vacuum slot 84.

Exemplary charging device shield 80 has a gap 86 between the end of vacuum slot 82 and the end of vacuum slot 84 in the longitudinal direction. In the fifth exemplary embodiment of charging device shield 80, the size of the longitudinal gap 86 is represented as x mm. In various exemplary embodiments, the value of x varies. For example, in various exemplary embodiments, the value of x of charging device shield 80 is the same as the values given to x for the gap 68 in FIG. 6, as described above and below.

In the fifth exemplary embodiment of charging device shield 80, the total vacuum flow is 3 scfm. Thus, the total vacuum flow in exemplary charging device shield 80 is the same as the total vacuum flow described above for the first exemplary charging device shield 40, the second exemplary charging device shield 50, the third exemplary charging device shield 60, and the fourth exemplary charging device shield 70. In various exemplary embodiments, the total vacuum flow for exemplary charging device shield 80 is a value other than 3 scfm.

In various exemplary embodiments, the total vacuum flow for exemplary charging device shield 80 is distributed evenly between exemplary vacuum slot 82 and exemplary vacuum slot 84. Thus, in one exemplary embodiment, the total vacuum flow for exemplary vacuum slot 82 is 1.5 scfm and the total vacuum flow for exemplary vacuum slot 84 is 1.5 scfm. In various other exemplary embodiments, the vacuum flow for vacuum slot 82 is different than the vacuum flow for vacuum slot 84. In various exemplary embodiments, the vacuum flows have other values.

Figure 9:
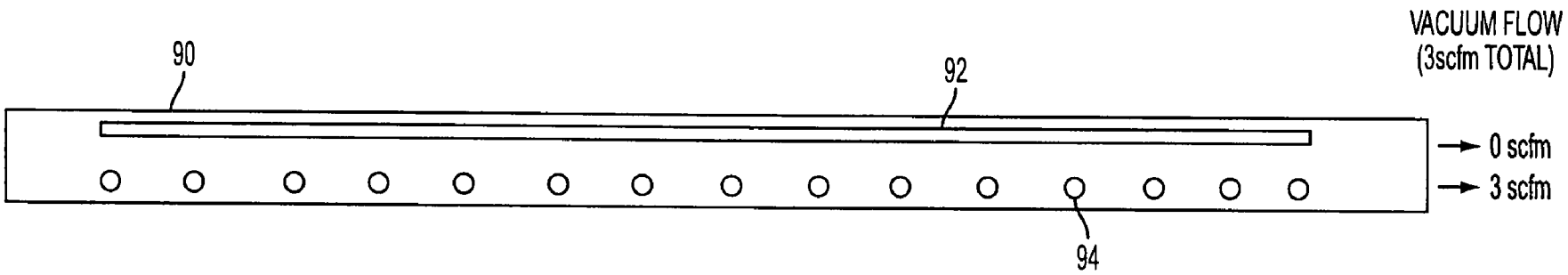
FIG. 9 is a top plan view of a sixth exemplary embodiment of a charging device shield.

FIG. 9 is a top plan view of a sixth exemplary embodiment of a charging device shield 90. Exemplary charging device shield 90 includes a single vacuum slot 92 and a plurality of vacuum holes 94. In the exemplary charging device shield 90, the plurality of vacuum holes 94 are arranged in an approximately linear fashion. In various exemplary embodiments, the plurality of vacuum holes 94 are arranged in an exactly linear fashion. In various exemplary embodiments, the plurality of vacuum holes 94 are arranged in a fashion that is not linear and not approximately linear.

In the depicted embodiment of a charging device shield 90, the linear extent of the vacuum holes 94 is the same as the length of the vacuum slot 92 in the longitudinal direction. In various exemplary embodiments, the arrangement of the vacuum holes 94 does not correspond to a length of the vacuum slot 92 in the longitudinal direction.

In exemplary charging device shield 90, the total vacuum flow is 3 scfm as with exemplary charging device shield 40, exemplary charging device shield 50, exemplary charging device shield 60, exemplary charging device shield 70 and exemplary charging device shield 80. In various exemplary embodiments, the total vacuum flow of exemplary charging device shield 90 is a value other than 3 scfm.

In the depicted embodiment of exemplary charging device shield 90, the total vacuum flow is distributed as follows. The vacuum slot 92 has a total flow of 0 scfm and the plurality of vacuum holes 94 have a total flow of 3 scfm distributed between them. In various other exemplary embodiments, the total vacuum flow for the exemplary charging device shield 90 is distributed between the vacuum slot 92 and the plurality of vacuum holes 94 in a different manner.

A comparison of the performance of exemplary charging device shield 90, with respect to the performance of exemplary charging device shield 40, exemplary charging device shield 50 and exemplary charging device shield 70 will be described in detail below in connection with FIGS. 12 and 13.

Figure 10:
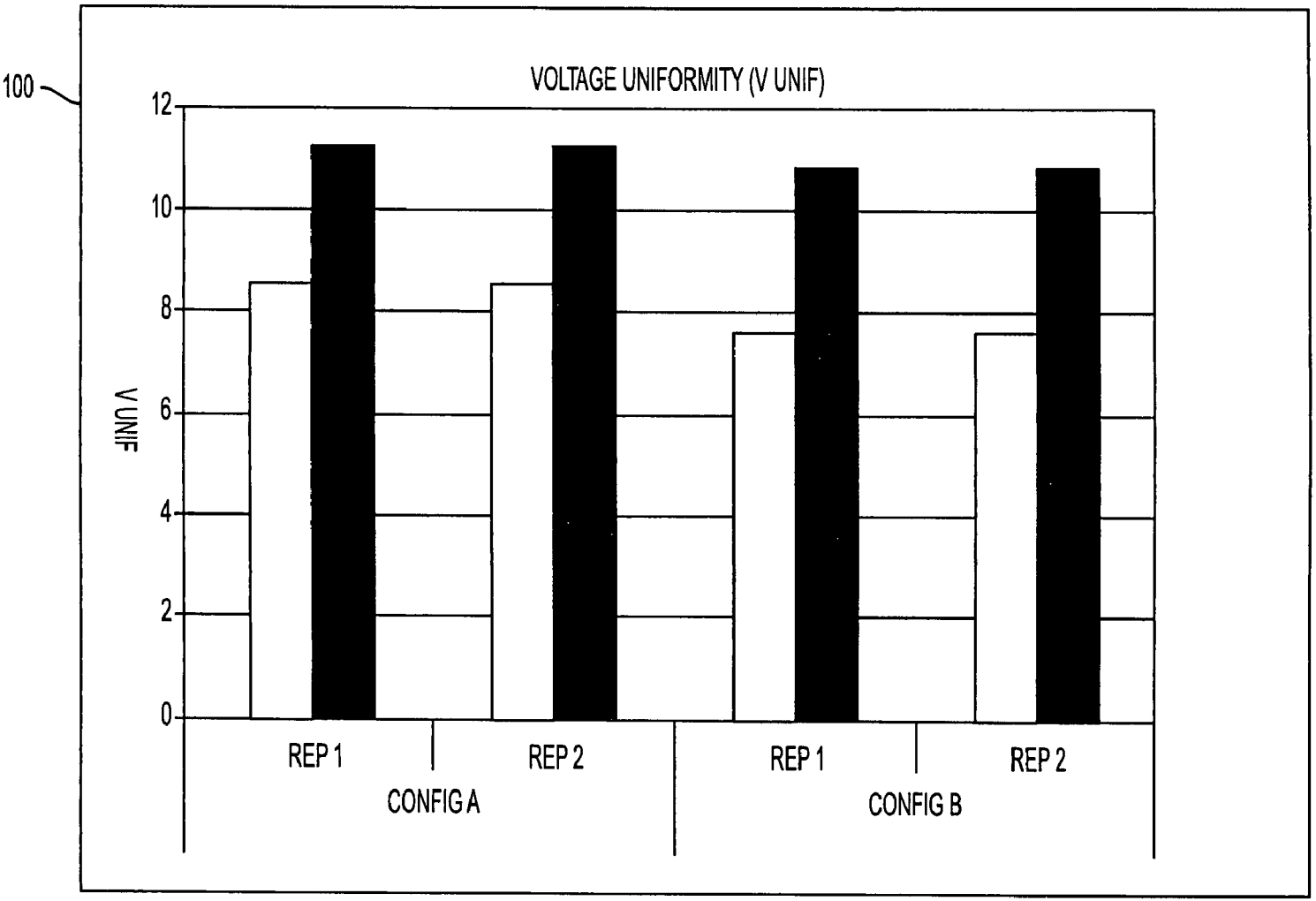
FIG. 10 is a graph showing exemplary test results of exemplary embodiments of charging device shields.

FIG. 10 is a graph 100 showing exemplary test results of exemplary embodiments of charging device shields. Graph 100 is a bar graph. The y-axis in graph 100 identifies the response of various tests performed on exemplary embodiments of a charging device shield. In graph 100, configuration A (Config A) refers to exemplary charging device shield 40. This nomenclature is also used in FIGS. 11-13. In exemplary graph 100, configuration B (Config B) refers to exemplary charging device shield 50.

Each of the exemplary embodiments of a charging device shield tested in the test results depicted in graph 100 were tested twice. These two tests are referred to as repetition 1 (Rep 1) and repetition 2 (Rep 2). The pairs of bars depicted for each of repetition 1 and repetition 2 in bar graph 100 correspond to tests at two different values of grid or bias voltage (Vg). The left-hand bar in the pair of bars for each repetition in graph 100 corresponds to a bias voltage of 200 volts. The right-hand bar in each pair of bars associated with each repetition in graph 100 corresponds to a bias voltage of 800 volts.

The y-axis in graph 100 represents the voltage uniformity (V Unif). The scale of the y-axis in graph 100 runs from 0 volts to 12 volts. In graph 100, the results of the tests are plotted based on the voltage uniformity limited to a range of six times the standard deviation of the data. In other words, the test results plotted in graph 100 filter out extreme spikes in the data in excess of six times the standard deviation before compiling the voltage uniformity data that is plotted in graph 100. Because six times the standard deviation corresponds to 99.9% of the full range of data, it is believed that the spikes filtered out when compiling the data plotted in graph 100 are unrealistic data points.

The lower the bar in graph 100, the lower the voltage uniformity measured in the tests depicted by that bar. An ideal voltage uniformity would be a measurement of 0 volts. Thus, the smaller the bar in graph 100, the better the voltage uniformity of the performance measured in the tests depicted by that bar.

Analyzing the test results depicted in graph 100 based on the above-described standard, it is clear that the voltage uniformity of the exemplary charging device shield 50 (Config B) is superior to the voltage uniformity of exemplary charging device shield 40 (Config A) at both values of Vg equal to 200 volts (left-hand bars) and Vg equal to 800 volts (right-hand bars) at both repetitions 1 and repetitions 2. The overall improvement achieved by exemplary charging device shield 50 with respect to exemplary charging device shield 40 is believed to be approximately 10 percent. Based on these test results, it is believed that the configuration for exemplary charging device shield 50 is preferable to the configuration for exemplary charging device shield 40. In other words, it is believe that it is preferable not to have overlapping vacuum slots in the longitudinal direction in a charging device shield.

Figure 11:
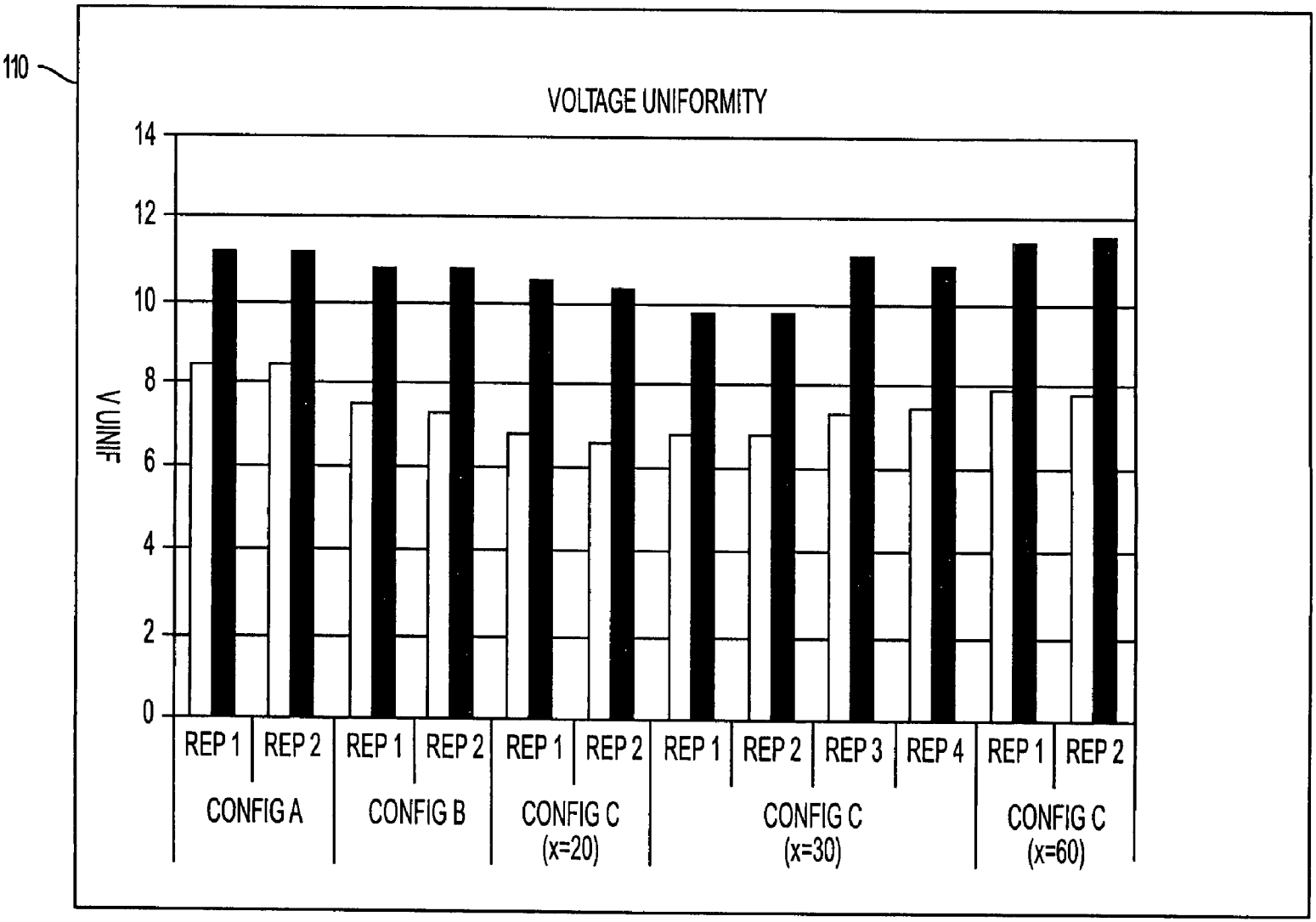
FIG. 11 is a graph showing additional exemplary test results of additional exemplary embodiments of charging device shields.

FIG. 11 is a graph 110 showing additional exemplary test results of additional exemplary embodiments of charging device shields. Graph 110 follows a format the same as graph 100. Thus, all of the descriptions associated with graph 100 are applicable to graph 110.

The leftmost four repetitions and associated four pairs of bars in graph 110 correspond to the data depicted in graph 100. The rightmost eight repetitions in graph 110 and associated rightmost eight pairs of bars correspond to test data not depicted in graph 100. Configuration C (Config C) in the x-axis of graph 110 corresponds to exemplary charging device shield 60.

In generating the data depicted in graph 110, three different versions of exemplary charging device shield 60 were tested. The three different versions of exemplary charging device shield 60 tested in generating data depicted in graph 110 correspond to three different values of x for the longitudinal gap 68. These three values of x are indicated in the x-axis of graph 110 in parentheses next to the three versions of configuration C. Those values are x=20, x=30 and x=60.

For the exemplary embodiment of charging device shield 60 having a value of x=20, two repetitions were tested in generating the data depicted in graph 110. For the exemplary embodiment of charging device shield 60 having a value of x=30, four repetitions were tested in generating the data depicted in graph 110. For the exemplary embodiment of charging device shield 60 having a value of x=60, two repetitions were tested in generating the data depicted in graph 110.

An analysis of the voltage uniformities depicted in graph 110 yield the following conclusions. In every case tested, exemplary charging device shield 60 had a voltage uniformity better than exemplary charging device shield 40 at a bias voltage of 200 $V_{AC}$ (leftmost bar in each bar pair). However, at higher values of x, exemplary charging device shield 60 had an inferior voltage uniformity with respect to exemplary charging device shield 40 at a bias voltage of 800 $V_{AC}$ (rightmost bar in each bar pair). Further, for all of the tests with a value of x=20 and for half of the tests with the value of x=30, the performance of exemplary charging device shield 60 achieved a superior voltage uniformity with respect to exemplary charging device shield 50 at both values of grid voltage tested (both bars in each bar pair).

Despite the test results described above, it is believe that exemplary charging device shield 60 may be undesirable for the following reasons. Exemplary charging device shield 60 contains portions of exposed wire without air flow. The portions of exposed wire without air flow in exemplary charging device shield 60 create concerns related to ozone emissions. It also induces a high risk of grid contamination that can cause IQ artifacts. For the foregoing reasons, it is believed that exemplary charging device shield 50 (Config B) is preferable to both exemplary charging device 40 (Config A) and exemplary charging device shield 60 (Config C). Therefore, the remaining tests exclude the third exemplary embodiment of charging device shield 60 (Config C).

Figure 12:
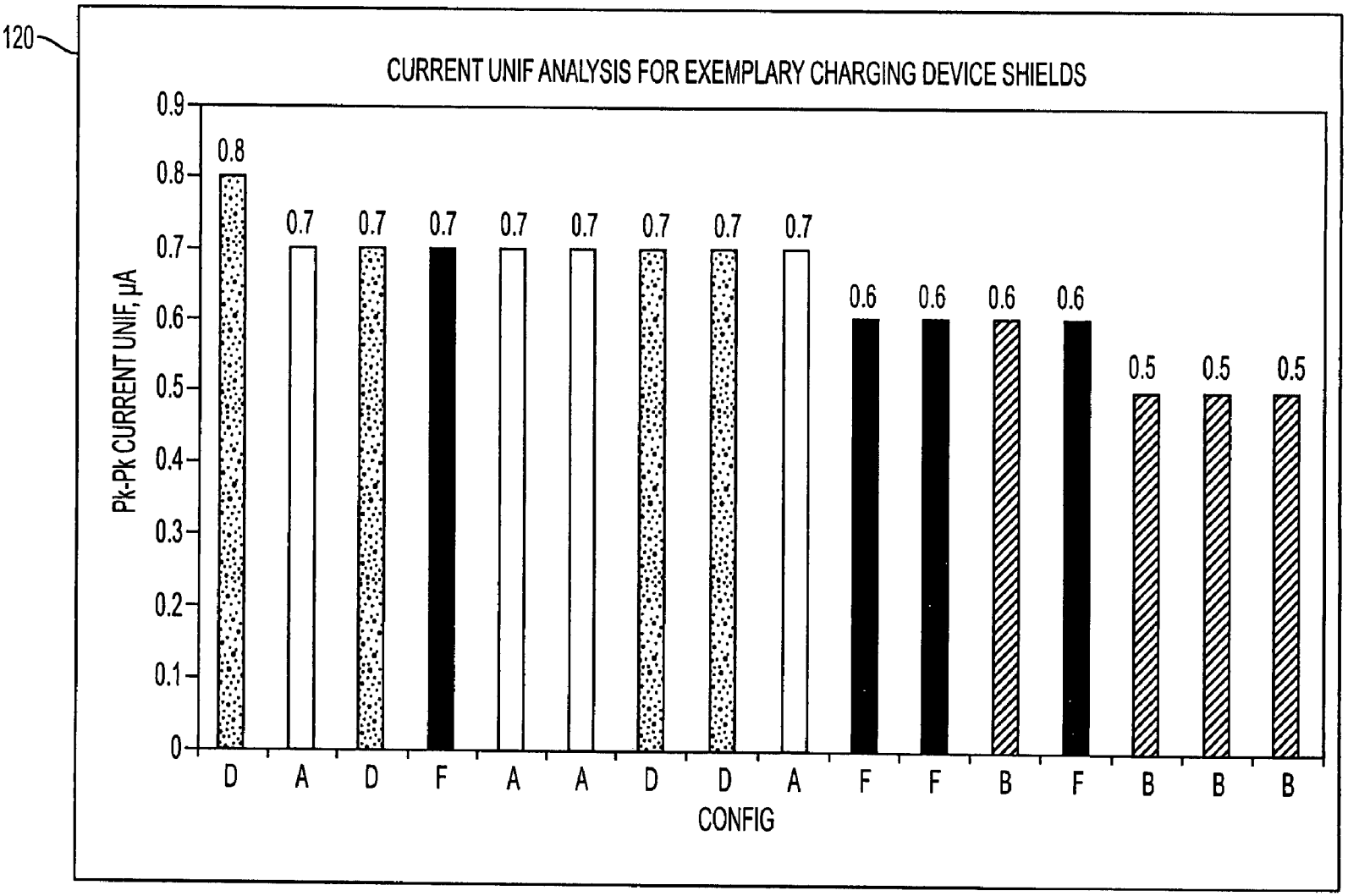
FIG. 12 is a graph showing other exemplary test results of exemplary embodiments of charging device shields.

FIG. 12 is graph 120 showing other exemplary test results of exemplary embodiments of charging device shields. The x-axis in graph 120 specifies the configuration (Config) tested in each of the bars depicted in graph 120. As in FIGS. 10 and 11, configuration A corresponds to exemplary charging device shield 40 and configuration B corresponds to exemplary charging device shield 50. Configuration D corresponds to exemplary charging device shield 70, and configuration F corresponds to exemplary charging device shield 90.

The y-axis of graph 120 corresponds to the peak-to-peak (Pk-Pk) current uniformity in units of micro amps (μA). As with voltage uniformity, also with respect to current uniformity, the lower the value of measured current uniformity, the greater the uniformity of the measured current. Thus, the smaller the bar in FIG. 12, the better the performance of the charging device, and correspondingly, the better the performance of the xerographic printing device. In the test results depicted in graph 120, each of the four configurations tested were tested four times.

Figure 13:
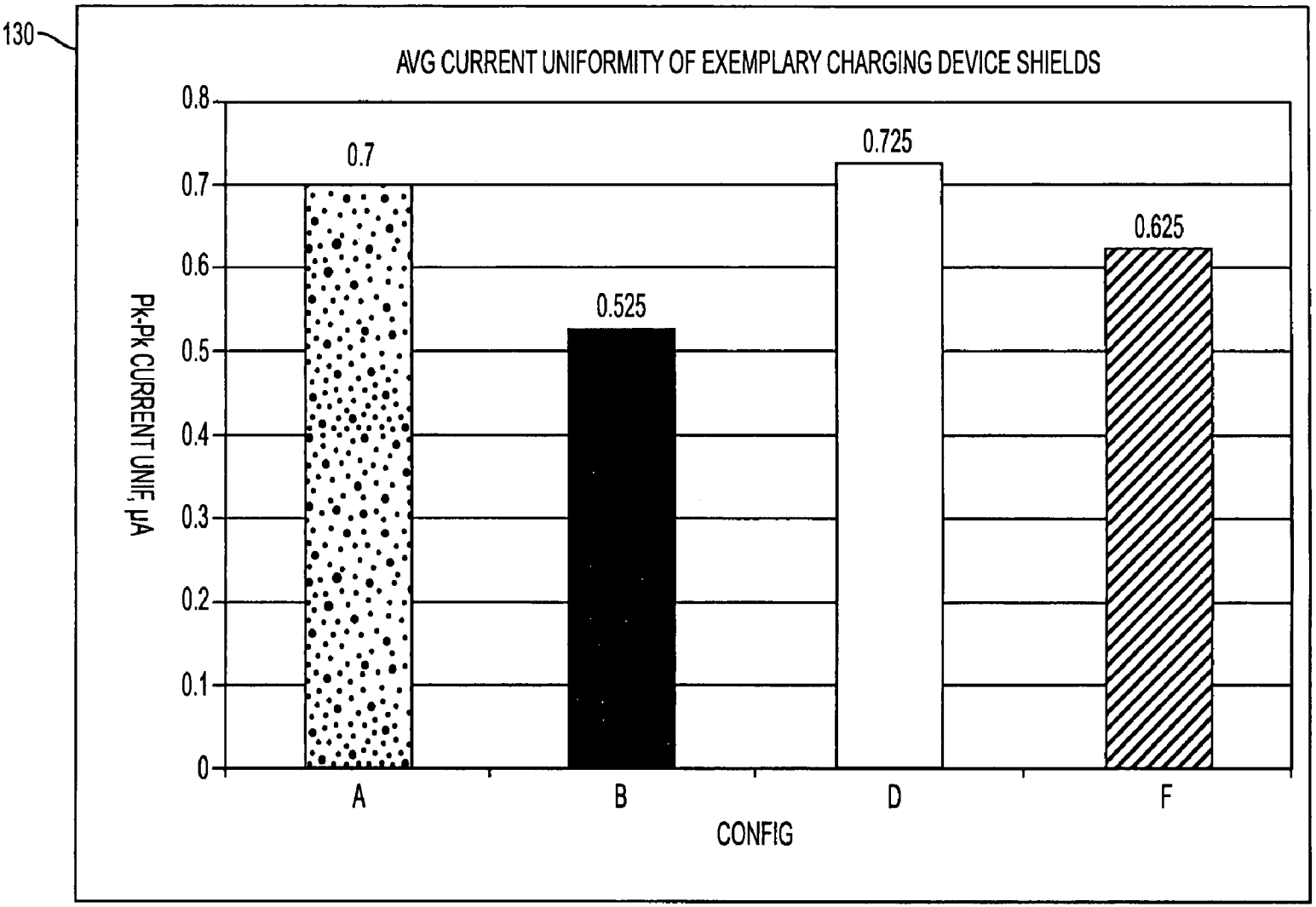
FIG. 13 is a graph showing a compilation of the exemplary test results of exemplary embodiments of charging device shields depicted in FIG. 12.

FIG. 13 is a graph 130 showing a compilation of the exemplary test results of exemplary embodiments of charging device shields depicted in graph 120. The data depicted in the four bars in graph 130 corresponds to the average of the four bars of individual test data depicted for each of the four configurations in graph 120 (sixteen bars total in FIG. 12).

It can be seen in FIG. 13 that, of the four exemplary embodiments of a charging device shield tested, the current uniformity is the worst for exemplary charging device shield 70 and the best for exemplary charging device shield 50. It is estimated that the improvement in current uniformity achieved by exemplary charging device shield 50 is approximately 25 percent better than the current uniformity of exemplary charging device shield 40. Also, given the poor current uniformity performance of exemplary charging device shield 70, it is believed that the configuration of exemplary vacuum slots 72 and 74 in exemplary charging device shield 70 should be avoided in designs where the operating parameters make the unit performance with respect to voltage uniformity critical.

Based on the test data depicted in FIGS. 10-13, and for the reasons described above, it is believed that the preferred embodiment of a shield for a charging device in a xerographic printing device is a shield having a plurality of orifices oriented such that there are no overlaps in a longitudinal direction between the orifices. Further, slots are cheaper to manufacture than holes. Thus, if slots are preferable to holes for reasons of reducing manufacturing costs, then it is believed that the ideal configuration of the slots in the shield is a configuration that has neither gaps nor overlaps in a longitudinal direction between two or more of a plurality of slots.

By achieving an improved voltage uniformity and current uniformity, the shield structure described above enables a more efficient operation of the charging devices. This more efficient operation of the charging devices creates a greater latitude in the associated print processes of the xerographic printing device. A higher efficiency in the charging and recharging processes enables more latitude in the exposing, developing and transferring processes of image formation in the xerographic printing device. An improved uniformity in the charge yields a higher accuracy of the subsequent exposing, developing and image transferring processes.

Further, the subsequent exposing, developing and transferring processes also have many inputs. An improved efficiency in the operating of the charging and recharging processes enables a greater tolerance at the margin of the other inputs to the exposing, developing and transferring processes. Further, if all other inputs to the system remain the same, an improvement in the efficiency of the charging and recharging processes will result in an improvement in the overall efficiency with which the system operates.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A xerographic printing device, comprising a charging device that includes a shield, wherein:

the shield includes three slots, two of which are offset in a first direction, the first direction corresponding to the direction in which a recording medium moves past the charging device in the xerographic printing device, two of the slots share a common axis in a second direction, the second direction being orthogonal to the first direction; and the two slots sharing the common axis in the second direction together have a capacity of about ⅔ of the total air flow through the shield, wherein the total air flow through the slots is about 3 standard cubic feet per minute.

2. The xerographic printing device according to claim 1, wherein the three slots have the same length in the second direction.

3. The xerographic printing device according to claim 1, wherein no overlap exists between any of the slots in the first direction.

4. The xerographic printing device according to claim 1, wherein no gap exists between any of the slots in the second direction.

5. The xerographic printing device according to claim 1, wherein a gap exists between at least two of the slots in the second direction.

6. The xerographic printing device according to claim 1, wherein the charging device is selected from the group consisting of a corotron, a dicorotron, a scorotron, a discorotron, a pin corotron, and a pin scorotron.

7. A shield for a charging device of a xerographic printing device, the shield comprising three slots, two of which are offset in a first direction, the first direction corresponding to the direction in which a recording medium moves past the charging device in the xerographic printing device, wherein two of the slots share a common axis in a second direction, the second direction being orthogonal to the first direction, the slots sharing the common axis in the second direction together have a capacity of about ⅔ of the total air flow through the shield, and the total air flow through the slots is about 3 standard cubic feet per minute.

8. The shield according to claim 7, wherein no overlap exists between any of the slots in the first direction.

9. The shield according to claim 7, wherein no gap exists between any of the slots in the second direction.

10. The shield according to claim 7, wherein a gap exists between at least two of the slots in the second direction.

11. The shield according to claim 7, wherein three slots have the same length in the second direction.

12. A xerographic printing device comprising a charging device that includes a shield, the shield having only three slots, wherein:

two of the slots are offset in a first direction, the first direction corresponding to the direction in which a recording medium moves past the charging device in the xerographic printing device, two of the slots share a common axis in a second direction, the second direction being orthogonal to the first direction; and the two slots sharing the common axis in the second direction together have a capacity of about ⅔ of the total air flow through the shield.

13. The xerographic printing device according to claim 12, wherein no overlap exists between any of the slots in the first direction.

14. The xerographic printing device according to claim 12, wherein no gap exists between any of the slots in the second direction.

15. The xerographic printing device according to claim 12, wherein a gap exists between at least two of the slots in the second direction.

16. The xerographic printing device according to claim 12, wherein the charging device is selected from the group consisting of a corotron, a dicorotron, a scorotron, a discorotron, a pin corotron, and a pin scorotron.

17. The xerographic printing device according to claim 12, wherein the total air flow through the slots is about 3 standard cubic feet per minute.

18. The xerographic printing device according to claim 12, wherein the three slots have the same length in the second direction.

* * * * *